US007392909B1

(12) United States Patent
Conrad

(10) Patent No.: US 7,392,909 B1
(45) Date of Patent: Jul. 1, 2008

(54) POOL LEAFING TOOL WITH STAY-OPEN BASKET FEATURE

(76) Inventor: James R. Conrad, 1518 Moffett St., Suite E, Salinas, CA (US) 93905

( * ) Notice: Subject to any disclaimer, the term of this patent is extended or adjusted under 35 U.S.C. 154(b) by 274 days.

(21) Appl. No.: 11/231,198

(22) Filed: Sep. 20, 2005

Related U.S. Application Data

(60) Provisional application No. 60/697,716, filed on Jul. 8, 2005.

(51) Int. Cl.
*E04H 4/16* (2006.01)

(52) U.S. Cl. ..... 210/471; 210/232; 210/238; 4/496

(58) Field of Classification Search ..... 210/232, 210/238, 470, 471; 4/496; 43/11
See application file for complete search history.

(56) References Cited

U.S. PATENT DOCUMENTS 156,488 A * 11/1874 Males ..... 210/489
2,283,488 A * 5/1942 Cox ..... 220/491
2,397,176 A * 3/1946 Whiting ..... 210/466
2,604,715 A * 7/1952 Brown, Jr. ..... 43/11
4,125,956 A * 11/1978 Killian ..... 43/11
4,638,968 A * 1/1987 Auten ..... 248/97
5,385,666 A * 1/1995 Perlsweig ..... 210/238
5,473,786 A 12/1995 Resh
5,858,221 A * 1/1999 Conrad ..... 210/471

* cited by examiner

*Primary Examiner*—Fred G. Prince
(74) *Attorney, Agent, or Firm*—Louis J. Bachand

(57) ABSTRACT

An increased efficiency, more durable pool leafing tool, and method, for gathering leaves and other pool debris from a pool bottom wall has a handle, a handle-controlled basket of a water-pervious and leaf and debris-impervious plastic mesh pocket having a closed end and an open end and a leaf and debris receiving volume therebetween formed by longitudinally extended sidewalls. The sidewalls provide an open end edge margin that is attached to a supporting frame. A pocket stay structure has one or more spring elements bent on themselves about the pocket closed end. The stay structure extends attached to the sidewalls for substantially the sidewall longitudinal extent length for biasing the mesh pocket volume against collapse onto itself in its empty or leaf and debris-filled condition to facilitate both gathering and disposal of leaves and debris from swimming pools.

7 Claims, 3 Drawing Sheets

POOL LEAFING TOOL WITH STAY-OPEN BASKET FEATURE

CROSS-REFERENCE TO RELATED APPLICATIONS

This application claims the benefit of U.S. Provisional Application Ser. No. 60/697,716, filed Jul. 8, 2005.

BACKGROUND OF THE INVENTION

1. Field of the Invention

This invention relates to an increased efficiency, more durably performing pool leafing tool, and method, for gathering leaves and other pool debris from a pool bottom wall. More particularly, the invention relates to a pool leafing tool that stays open in the pool, and when emptying into a trash receptacle. The invention further relates to manufacturing and operating benefits afforded by the present leafing tool design, including easy assembly of components in manufacturing, repair and replacement, active protection of costly abradable components with low-cost sacrificial components, and integration of durability in design through use of such components with designed-in manufacturing ease in these components for an optimized pool leafing product in manufacture and use.

2. Description of the Related Art

Pool leafing tools are commonly used to remove leaves and other debris that collect in recreational pools over time. Typically, a pool owner or service technician will remove large debris including leaves, flowers and twigs with the pool leafing tool. A problem with many pool leafing products is that the basket used to collect the debris is merely a bag or pocket supported by a frame at the mouth, and the bag collapses across the mouth when one seeks to empty it into a receptacle. In FIG. 1 (PRIOR ART) technician 7 holds tool 9 comprising a handle 11 attached to the bag 13*a* containing debris 13*b* over receptacle 15, but the bag, being loaded and unsupported except by itself, sags down past the bag mouth 17, effectively blocking expulsion of the accumulated debris; only a little debris 19 exits. The technician has to hold the bag closed end 23 up and shake the tool 9, necessarily up close to the bag 13*a*, losing the leverage otherwise provided by the handle 9. For a professional who does as many as 60 pools a day, this extra effort can be quite fatiguing, leading to spillage, errors and an unhappy customer.

BRIEF SUMMARY OF THE INVENTION

It is an object of the invention therefore to provide a better pool leafing tool and an improved pool leafing method. It is a further object to provide a pool leafing tool in which the debris container does not collapse in the pool or when emptying the container. A further object includes provision of a pool leafing tool that has resilient stays attached to the mesh pocket that receives debris to keep the pocket open. Other objects include having the stays project from the mesh to slide on the pool bottom wall to protect the mesh from abrasions, fitting the mesh to a ring frame, fastened with a snap fastener, and covering the fastened and frame-engaged mesh with a separable protective tip including a wedge at one side to assist in debris gathering and a concave receiver at the other shaped and arranged to snap over the frame, mesh and fastener, Other objects will appear hereinafter.

These and other objects of the invention to become apparent hereinafter are realized in a pool leafing tool for gathering leaves and other pool debris from a pool bottom wall, the tool comprising a hand-manipulable basket comprising a water-pervious and leaf and debris-impervious mesh pocket having a closed end and an open end and a leaf and debris receiving volume therebetween, the open end having an edge margin, a pocket supporting frame attached to the pocket edge margin and disposed about the open end, and a pocket stay structure biasing the mesh pocket volume against collapse onto itself in its empty or leaf and debris-filled condition.

In this and like embodiments, typically, the pocket stay biasing structure is attached to the mesh pocket and free of attachment to the supporting frame, the pocket stay biasing structure comprises plural, spaced apart flexible spring members attached to the mesh pocket and free of attachment to the supporting frame, the pocket stay biasing structure is generally U-shaped to have a bottom portion opposite the pocket closed end and first and second leg portions attached to the mesh pocket in opposed relation across the volume, the pocket stay biasing structure comprises plural, spaced apart, flexible, U-shaped, plastic surface spring members, the members being free of attachment to the supporting frame, the mesh pocket has an inner and an outer surface, and the pocket stay biasing structure is attached to the outer surface, and the pocket biasing structure comprises plural raised members arranged to skid along the pool bottom wall in mesh pocket abrasion-reducing relation.

Further, typically, the pool leafing tool includes a handle attached to the frame, the basket comprises plastic mesh, the frame comprises a self-supporting ring, the open edge margin at least partially encircling the ring in attached relation, there is a fastener attaching the open edge margin to the frame ring, the fastener comprises a resilient split sleeve, the sleeve being snapped over the frame in edge margin attaching relation to the frame, the frame ring is circular in cross-section, the split sleeve being congruent in cross-section with the frame ring, the supporting frame defines a pool bottom wall skimming lip at the pocket open end arranged to slide along the bottom wall in leaf and debris gathering relation, a pool bottom wall skimming tip is provided separably attached to frame skimming lip, the skimming tip comprises a resilient body having a wedge-shaped leading edge and a concave trailing edge, the tip body leading edge being adapted to skim the pool bottom wall, the tip body trailing edge being adapted to snap attach to the frame skimming lip, and/or the pocket open end edge margin at least partially encircles the frame skimming lip, the edge margin being protected against pool bottom wall abrasion by the tip body.

In a further embodiment, the invention provides a pool leafing tool for gathering leaves and other pool debris from a pool bottom wall, the tool comprising a handle, a handle-controlled basket comprising a water-pervious and leaf and debris-impervious plastic mesh pocket having a closed end and an open end and a leaf and debris receiving volume therebetween having longitudinally extended sidewalls, the sidewalls defining an open end edge margin, a pocket supporting frame attached to the edge margin and disposed in a frame plane including the open end, and a pocket stay structure comprising a spring element or member bent on itself about the pocket closed end and disposed in a stay structure plane substantially normal to the frame plane, the stay structure extending attached to the sidewalls for substantially the sidewall longitudinal extent length thereof for biasing the mesh pocket volume against collapse onto itself in its empty or leaf and debris-filled condition.

In this and like embodiments, typically, the pocket stay biasing structure is sidewall-attached along from 25 to 95% of the sidewall longitudinal extent, and is free of attachment to the supporting frame, the pocket stay biasing structure comprises plural, spaced apart, parallel, bent spring members, the pocket stay biasing structure spring members have first and second leg portions attached to the mesh pocket in opposed relation across the volume, the pocket stay biasing structure spring members have a plastic surface, the mesh pocket has an inner and an outer surface, the pocket stay biasing structure spring members being attached to the outer surface, the pocket biasing structure spring members are raised members from the mesh pocket and arranged to skid along the pool bottom wall in mesh pocket abrasion-reducing relation, the frame comprises a self-supporting ring, the open edge margin at least partially encircling the ring in attached relation, there is also included a fastener attaching the open edge margin to the frame ring, the fastener comprises a resilient split sleeve, the sleeve being snapped over the frame in edge margin attaching relation to the frame, the frame ring is circular in cross-section, the split sleeve being congruent in cross-section with the frame ring, the supporting frame defines a pool bottom wall skimming lip at the pocket open end arranged to slide along the bottom wall in leaf and debris gathering relation, a pool bottom wall skimming tip is separably attached to frame skimming lip, the skimming tip comprises a resilient body having a wedge-shaped leading edge and a concave trailing edge, the tip body leading edge being adapted to skim the pool bottom wall, the tip body trailing edge being adapted to snap attach to the frame skimming lip, the pocket open end edge margin at least partially encircles the frame skimming lip, the edge margin being protected against pool bottom wall abrasion by the tip body.

In a highly particular embodiment, the invention provides a pool leafing tool for gathering leaves and other pool debris from a pool bottom wall, the tool comprising a handle, a handle-controlled basket comprising a water-pervious and leaf and debris-impervious plastic mesh pocket having a closed end and an open end and a leaf and debris receiving volume therebetween having longitudinally extended sidewalls, the sidewalls defining an open end edge margin, a pocket supporting frame attached to the edge margin and disposed in a frame plane including the open end, and a pocket stay structure free of attachment to the frame and comprising plural, spaced apart, parallel spring members bent on themselves about the pocket closed end and disposed in a stay structure plane substantially normal to the frame plane, the stay structure members extending attached to the sidewalls on the outer surface of the pocket for 25% to 95% of the sidewall longitudinal extent for biasing the mesh pocket volume against collapse onto itself in its empty or leaf and debris-filled condition, the members projecting outward from the sidewalls and being arranged to skid along the pool bottom wall in mesh pocket abrasion-reducing relation; the frame comprising a self-supporting ring, the open edge margin at least partially encircling the ring, a fastener attaching the open edge margin to the frame ring, the fastener comprising a resilient split sleeve generally congruent with the frame ring cross section, the sleeve being snapped over the frame in edge margin attaching relation to the frame, the frame defining a pool bottom wall skimming lip at the pocket open end arranged to slide along the bottom wall in leaf and debris gathering relation, and a pool bottom wall skimming tip separably attached to frame skimming lip and comprising a resilient body having a wedge-shaped leading edge and a concave trailing edge, the tip body leading edge being adapted to skim the pool bottom wall, the tip body trailing edge being adapted to snap attach to the frame skimming lip, and the pocket open end edge margin at least partially encircles the frame skimming lip, the edge margin being protected against pool bottom wall abrasion by the tip body.

In its method aspects the invention provides a method of clearing swimming pool water of leaves and debris including sweeping through the water in leaf and debris gathering relation a basket comprising a non-self-supporting mesh pocket, biasing the mesh pocket open by a resilient stay structure, lifting the basket with gathered leaves and debris to a receptacle for emptying at an orientation in which the mesh pocket tends to collapse on itself from the weight of the leaves and debris, and keeping the pocket uncollapsed with the stay structure during emptying thereof into the receptacle.

In this and like method embodiments, typically, the method includes separately biasing spaced portions of the mesh basket, attaching the resilient stay structure to the outside of the mesh basket, and interposing the stay structure between the mesh basket and the adjacent wall of the swimming pool in mesh abrasion limiting relation, attaching an edge margin of the mesh pocket to a frame with a fastener, and covering the attached edge margin and fastener with a covering against edge margin abrasion against a wall of the swimming pool, and defining a leaf and debris skimming leading edge on the covering.

A further method invention includes a method of manufacturing a pool leafing tool including defining a frame adapted to be carried by a handle, at least partially encircling the frame with the edge margin of a pocket shaped mesh, snapping a split sleeve fastener over the encircling edge margin and frame, and biasing the pocket open with resilient stay structure beyond the frame.

In this and like embodiments, typically, the method includes separately biasing spaced portions of the pocket shaped mesh, attaching the resilient stay structure to the outside of the pocket shaped mesh in mesh abrasion limiting relation, and covering the attached edge margin and fastener with a separable tip covering against edge margin abrasion against a wall of the swimming pool.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
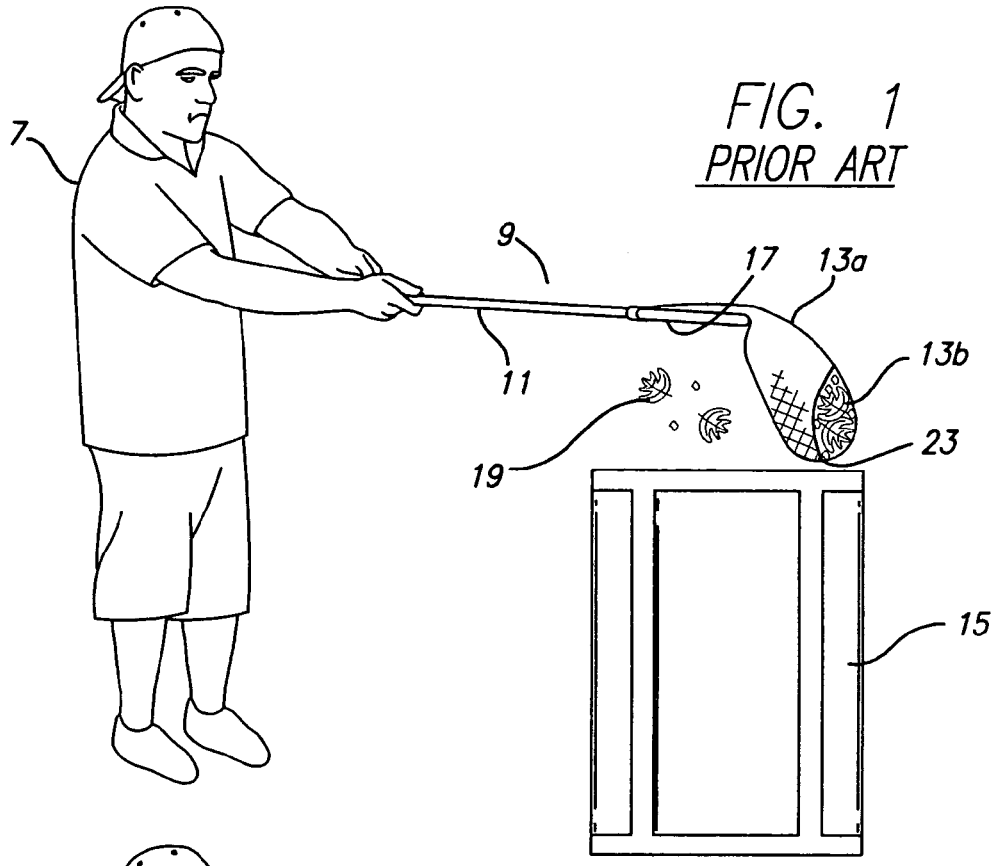
FIG. 1 PRIOR ART
FIG. 1 (PRIOR ART) is a pictorial view of a pool leafing tool according to the prior art.
Figure 2:
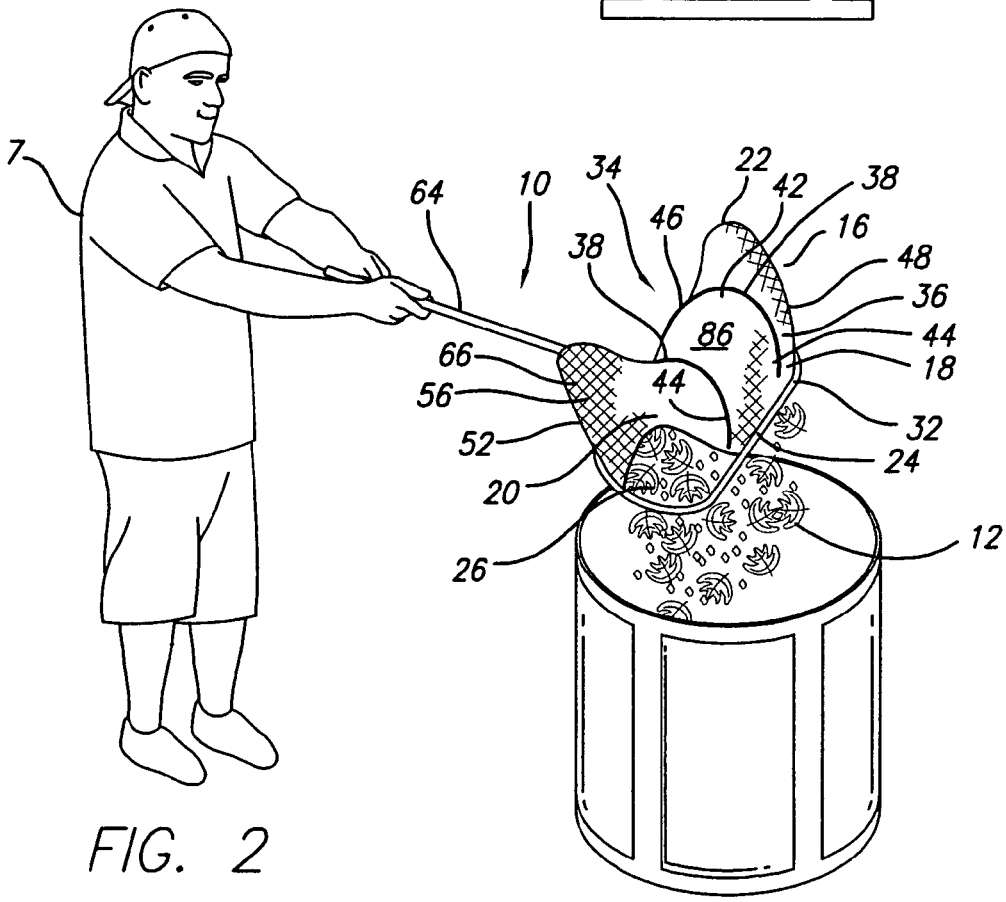
FIG. 2 is a view of a pool leafing tool according to the invention.
Figure 3:
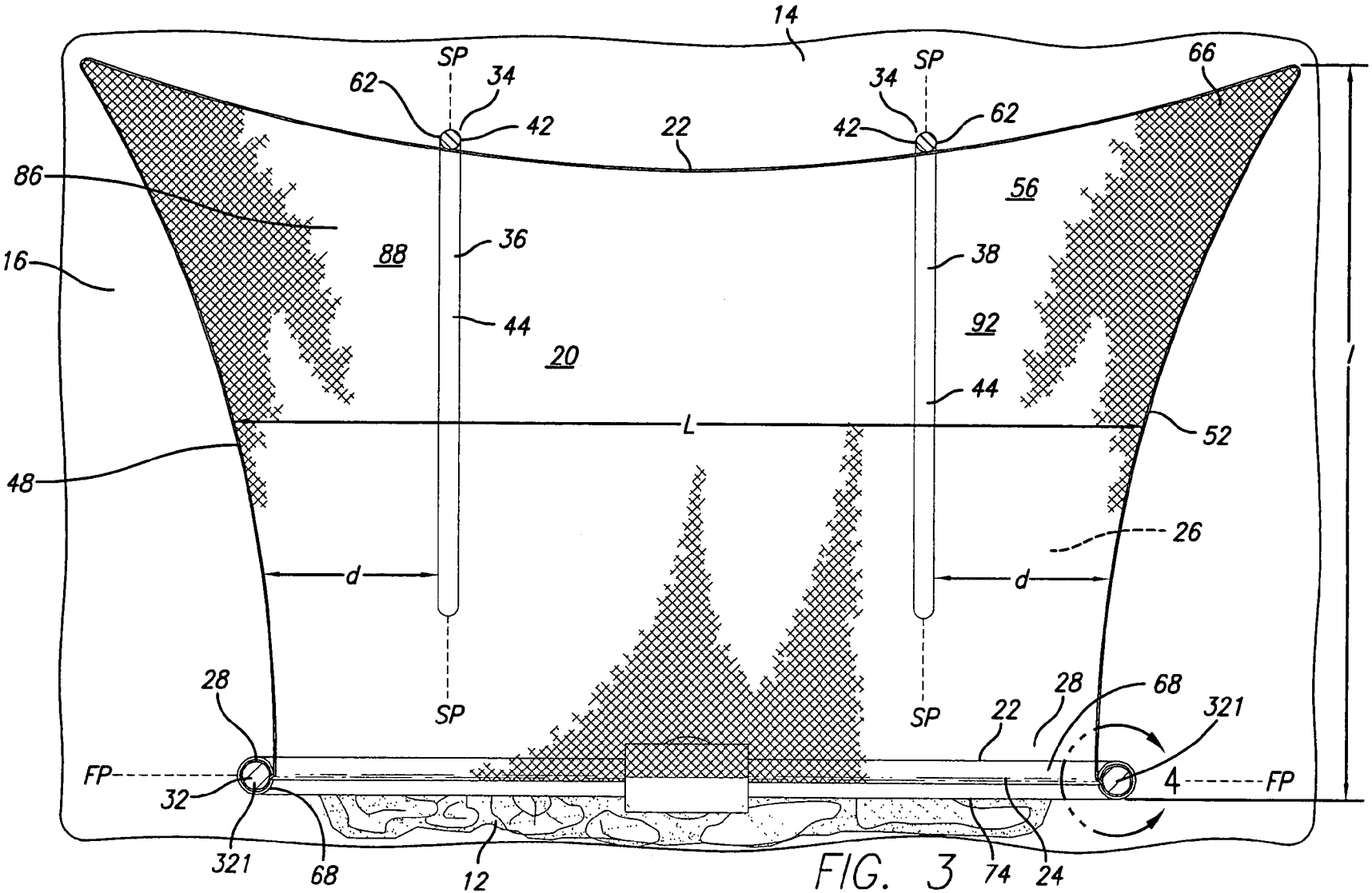
FIG. 3 is a front elevation view of the pool leafing tool.
Figure 4:
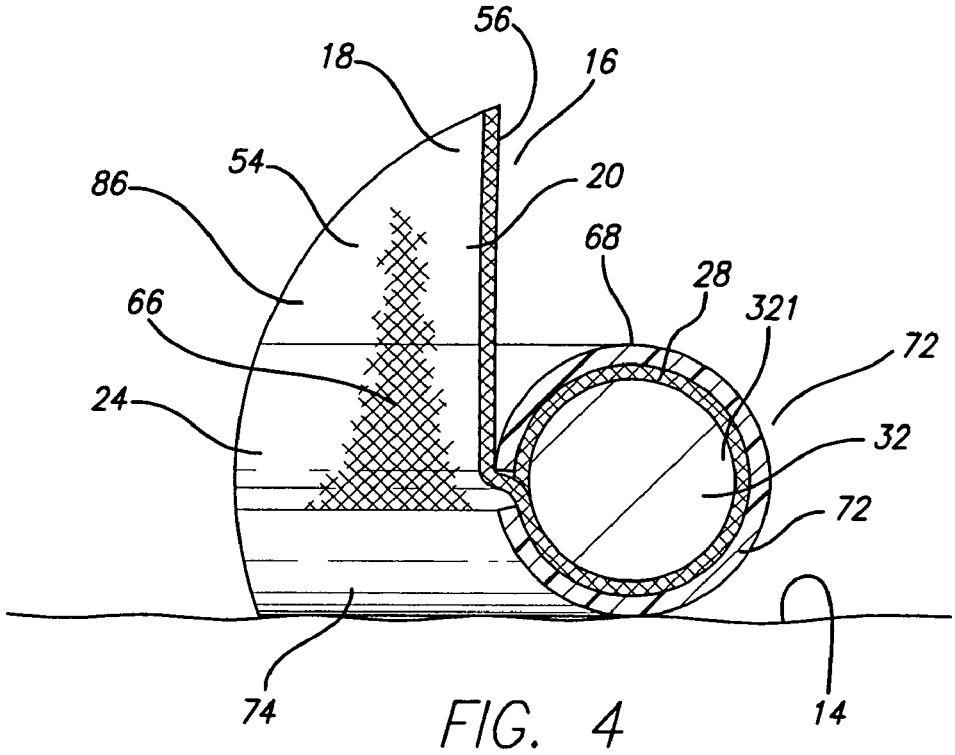
FIG. 4 is a fragmentary detail view taken on line 4 in FIG. 3.
Figure 5:
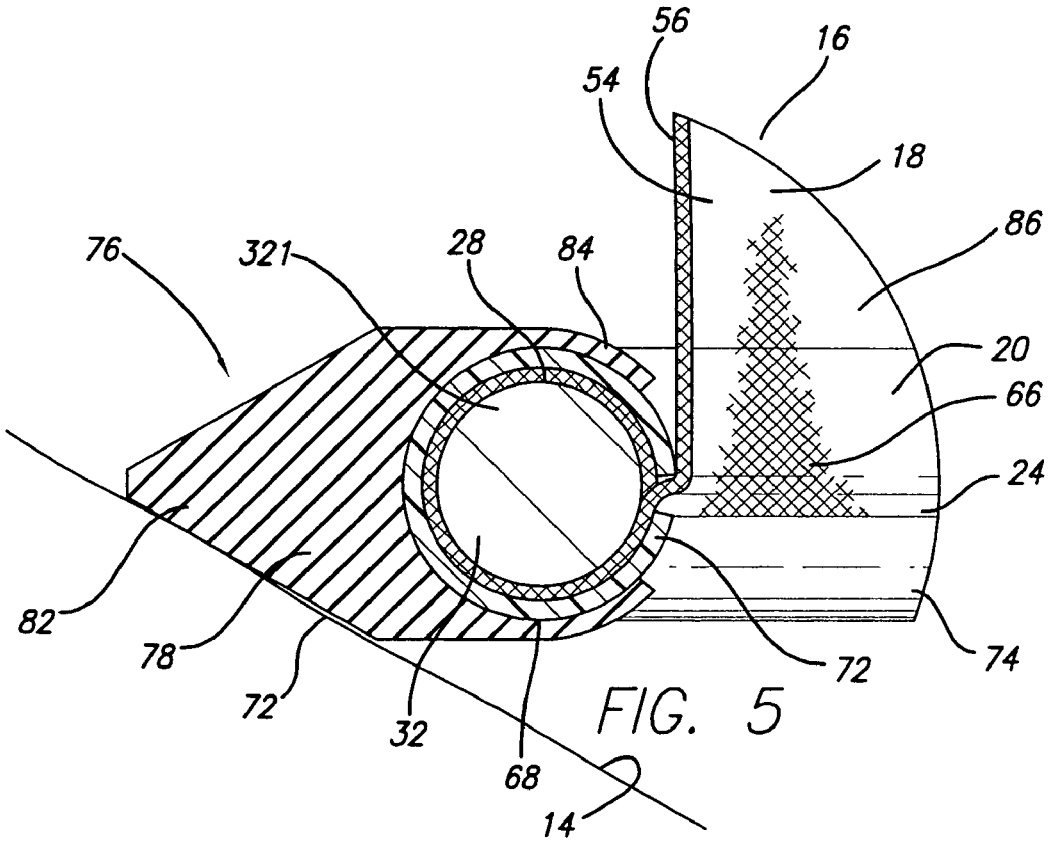
FIG. 5 is a view like FIG. 4 of an alternate embodiment.

With reference now to the drawings in detail, in FIGS. 2-5 the invention pool leafing tool 10 is adapted for use by a technician 7 in gathering leaves and other pool debris 12 from a pool bottom wall 14. Tool 10 comprises a hand-manipulable basket 16 comprising a water-pervious and leaf and debris-impervious mesh pocket 18 of having a closed end 22 and an open end 24 and a leaf and debris receiving volume 26 therebetween. Mesh pocket open end 24 has an edge margin 28, a pocket supporting frame 32 attached to the pocket edge margin and disposed about the open end. A pocket stay structure 34 biases the mesh pocket volume 26 against collapse onto itself in its empty or leaf and debris-filled condition. Compare FIGS. 1 and 2. Pocket stay structure 34 is attached to the mesh pocket 18, preferably free of attachment to the supporting frame 32, as shown.

Pocket stay structure 34 in this embodiment comprises plural, e.g. two as shown, spaced apart flexible spring members 36, 38 attached to the mesh pocket 18, both free of attachment to the supporting frame 32. Each member 36, 38 of the pocket stay structure 34 is generally U-shaped, as shown, to have a bottom portion 42 opposite the pocket closed end 22 and first and second leg portions 44, 46 attached to the mesh pocket 18 in opposed relation across the volume 26. Members 36, 38 are flexible, U-shaped and plastic-surfaced if not entirely plastic. Members 36, 38 are laterally spaced apart to be preferably equidistant from the pocket ends 48, 52 and each at a distance d from the pocket ends equal to from about 10% to about 40% of the median lateral extent L of the mesh pocket 18.

The mesh pocket 18 has an inner surface 54 and an outer surface 56; pocket stay structure 34 is attached to the outer surface. Pocket stay structure 34 preferably comprises plural raised members 36, 38 projecting from the pocket outer surface 56 and arranged to skid along the pool bottom wall 14 in mesh pocket abrasion-reducing relation, e.g. at 62, FIG. 3.

Further, typically, pool leafing tool 10 includes a handle 64 attached to the frame 32, Basket 16 comprises plastic mesh fabric 66 of 8×8, 14×18, or 20×20 strands per inch, typically or a more or less fine mesh. Frame 32 comprises a self-supporting ring 321. Pocket open edge margin 28 at least partially, and preferably fully, encircles the ring 321 in attached relation. Illustrative of the manufacturing ease the invention affords, the mesh 66 is simply clipped to the ring 321 by encircling the ring with the edge margin 28 and applying the fastener 68 comprised of a resilient longitudinally split sleeve 72 over the assembled ring and edge margin. Split sleeve 72 is snapped over the frame ring 321 in edge margin 28 attaching relation to the frame 32. Frame ring 321 is typically circular in cross-section, as shown, and the split sleeve 72 is congruent in cross-section with the frame ring.

The supporting frame 32 defines a pool bottom wall 14 skimming lip 74 at the pocket open end 24 arranged to slide along the bottom wall in leaf and debris gathering relation. A pool bottom wall skimming tip 76 is also provided in the FIG. 5 embodiment, separably attached to frame skimming lip 74. Skimming tip 76 comprises a resilient body 78 having a wedge-shaped leading edge 82 and a concave trailing edge 84. Leading edge 82 is shaped to be adapted to skim the pool bottom wall 14. Tip body trailing edge 84 is shaped to be adapted to snap attach to the frame skimming lip 74. The pocket open end edge margin 28 thus at least partially encircles the frame skimming lip 74, and the fabric 66 of the edge margin 28 is protected against pool bottom wall abrasion by the tip body 78. Tip 76 is relatively inexpensive and replaceable and is sacrificed to protect the mesh pocket edge margin 28 and fastener 68.

In a further embodiment, pool leafing tool 10 comprises handle 64, a handle-controlled basket 16 comprising a water-pervious and leaf and debris-impervious plastic mesh pocket 18 having a closed end 22 and an open end 24 and a leaf and debris receiving volume 26 therebetween having longitudinally extended sidewalls 86. Sidewalls 86 define open end edge margin 28. Pocket supporting frame 32 is attached to the edge margin 28 and disposed in a frame plane FP including the open end 24. Pocket stay structure 34 comprises spring elements or members 36, 38, each bent on itself about the pocket closed end 22 and disposed in a stay structure plane SP substantially normal to the frame plane FP. Stay structure 34 extends attached to the sidewalls 86 for substantially the sidewall longitudinal extent length l thereof for biasing the mesh pocket volume 26 against collapse onto itself in its empty or leaf and debris-filled condition.

Typically, the pocket stay structure 34 is sidewall-attached along from 25 to 95% of the sidewall longitudinal extent 1, and is free of attachment to the supporting frame 32. Pocket stay structure 34 comprises plural, spaced apart, parallel, bent spring elements or members 36, 38 which have first and second leg portions 44, 46 attached to the mesh pocket 18 in opposed relation across the volume 26. Pocket stay structure 34 spring members 36, 38 have a plastic surface 40. Mesh pocket 18 has an inner surface 54 and an outer surface 56, the pocket stay biasing structure spring members 36, 38 being attached to the outer surface by gluing or heat bonding. Pocket stay structure spring members 36, 38 are raised members from the mesh pocket 18 and arranged to skid along the pool bottom wall 14 in mesh pocket abrasion-reducing relation.

Frame 32 comprises a self-supporting ring 321, the open edge margin 24 at least partially encircling the ring in attached relation. Fastener 68 attaches the open edge margin 28 to the frame ring 321. Fastener 68 comprises a resilient split sleeve 72, the sleeve being snapped over the frame 32 in edge margin attaching relation to the frame. Typically, the frame ring 321 is circular in cross-section, the split sleeve 72 being congruent in cross-section with the frame ring. The supporting frame 32 defines a pool bottom wall skimming lip 74 at the pocket open end 24 arranged to slide along the bottom wall 14 in leaf and debris 12 gathering relation. A pool bottom wall skimming tip 76 is separably attached to frame skimming lip 74. Skimming tip 76 comprises resilient body 78 having a wedge-shaped leading edge 82 and a concave trailing edge 84, the tip body leading edge 82 being adapted to skim the pool bottom wall 14. Tip body trailing edge 84 is adapted to snap attach to the frame skimming lip 74. Pocket open end edge margin 28 at least partially encircles the frame skimming lip 74; the edge margin 28 being thus protected against pool bottom wall 14 abrasion by the tip body 78.

In a highly particular embodiment, the invention provides pool leafing tool 10 for gathering leaves and other pool debris 12 from a pool bottom wall 14. Tool 10 comprises a handle 64, a handle-controlled basket 16 comprising a water-pervious and leaf and debris-impervious plastic mesh pocket 18 having a closed end 22 and an open end 24 and a leaf and debris receiving volume 26 therebetween having longitudinally extended sidewalls 86. Sidewalls 86 define an open end edge margin 28. Pocket supporting frame 32 is attached to the edge margin 28 and disposed in a frame plane FP including the open end 24. Pocket stay structure 34, free of attachment to the frame 32, comprises plural, spaced apart, parallel spring members 36, 38 bent on themselves about the pocket closed end 22 and disposed in a stay structure plane SP substantially normal to the frame plane FP. Stay structure members 36, 38 extend attached to the sidewalls 86 on the outer surface 56 of the pocket 18 for 25% to 95% of the sidewall longitudinal extent l for biasing the mesh pocket volume 26 against collapse onto itself in its empty or leaf and debris-filled condition. Members 36, 38 project outward from the sidewalls 86 and are arranged to skid along the pool bottom wall 14 in mesh pocket 18 abrasion-reducing relation.

Frame 32 comprises a self-supporting ring 321; open edge margin 28 at least partially encircles the ring. A fastener 68 attaches the open edge margin 28 to the frame ring 321. Fastener 68 comprises a resilient split sleeve 72 generally congruent with the frame ring 321 cross section and snapped over the frame 32 in edge margin attaching relation to the frame. Frame 32 defines a pool bottom wall 14 skimming lip 74 at the pocket open end 24 arranged to slide along the bottom wall 14 in leaf and debris gathering relation. A pool bottom wall skimming tip 76 is separably attached to frame skimming lip 74 and comprises a resilient body 78 having a wedge-shaped leading edge 82 and a concave trailing edge 84. Tip body leading edge 82 is adapted to skim the pool bottom wall 14; tip body trailing edge 84 is adapted to snap attach to the frame skimming lip 74. As the pocket open end edge margin 28 at least partially encircles the frame skimming lip 74 presence of the tip body 78 thereover protects the edge margin 28 against pool bottom wall 14 abrasion.

The invention method of clearing swimming pool water of leaves and debris includes sweeping through the water in leaf and debris gathering relation a basket 16 comprising a non-self-supporting mesh pocket 18, biasing the mesh pocket open by a resilient stay structure 34, lifting the basket with gathered leaves and debris to a receptacle 15 for emptying at an orientation in which the mesh pocket tends to collapse on itself from the weight of the leaves and debris, and keeping the pocket uncollapsed with the stay structure during emptying thereof into the receptacle.

Typically the method further includes separately biasing spaced portions 88, 92 of the mesh basket 16, attaching the resilient stay structure 34 to the outside 56 of the mesh basket, and interposing the stay structure between the mesh basket and the adjacent wall 14 of the swimming pool in mesh abrasion limiting relation, attaching an edge margin 28 of the mesh pocket 18 to a frame with a fastener 68, and covering the attached edge margin and fastener with a covering tip 76 against edge margin abrasion against a wall 14 of the swimming pool, and defining a leaf and debris skimming leading edge on the covering tip.

The invention method of manufacturing a pool leafing tool 10 includes defining a frame 32 adapted to be carried by a handle 64, at least partially encircling the frame with the edge margin 28 of a pocket shaped mesh 18, snapping a split sleeve fastener 72 over the encircling edge margin and frame, and biasing the pocket open with resilient stay structure 34 beyond the frame. Typically, the method further includes separately biasing spaced portions 88, 92 of the pocket shaped mesh, attaching the resilient stay structure 34 to the outside 56 of the pocket shaped mesh in mesh abrasion limiting relation, and covering the attached edge margin 28 and fastener with a separable tip covering 76 against edge margin abrasion against a wall 14 of the swimming pool.

The invention thus provides a better pool leafing tool and an improved pool leafing method in which the debris container does not collapse in the pool or when emptying the container through use of resilient stays attached to the mesh pocket that receives debris to keep the pocket open while the stays project from the mesh to slide on the pool bottom wall to protect the mesh from abrasions, fitting of the mesh to a ring frame and fastening with a snap fastener, and covering the fastened and frame-engaged mesh with a separable protective tip including a wedge at one side to assist in debris gathering and a concave receiver at the other shaped and arranged to snap over the frame, mesh and fastener.

The foregoing objects are thus met.

I claim:

1. A pool leafing tool for gathering leaves and other pool debris from a pool bottom wall, said tool comprising a handle, a handle-controlled basket comprising a water-pervious and leaf and debris-impervious plastic mesh pocket having a closed end and an open end and a leaf and debris receiving volume therebetween having longitudinally extended sidewalls, said sidewalls defining an open end edge margin, a pocket supporting frame attached to said edge margin and disposed in a frame plane including said open end, and a pocket stay structure comprising a spring member bent on itself about said pocket closed end and disposed in a stay structure plane substantially normal to said frame plane, said stay structure extending attached to said sidewalls for substantially the sidewall longitudinal extent length thereof for biasing said mesh pocket volume against collapse onto itself in its empty or leaf and debris-filled condition.

2. The pool leafing tool according to claim 1, in which said pocket stay biasing structure is sidewall-attached along from 25 to 95% of said sidewall longitudinal extent, and is free of attachment to said supporting frame.

3. The pool leafing tool according to claim 2, in which said pocket stay biasing structure comprises plural, spaced apart, parallel, bent spring members.

4. The pool leafing tool according to claim 3, in which said pocket stay biasing structure spring members have first and second leg portions attached to said mesh pocket in opposed relation across said volume.

5. The pool leafing tool according to claim 4, in which said pocket stay biasing structure spring members have a plastic surface.

6. The pool leafing tool according to claim 4, in which said mesh pocket has an inner and an outer surface, and said pocket stay biasing structure spring members being attached to said outer surface.

7. The pool leafing tool according to claim 6, in which said pocket biasing structure spring members are raised members from said mesh pocket and arranged to skid along said pool bottom wall in mesh pocket abrasion-reducing relation.

* * * * *